US007775361B2

(12) United States Patent
Ficai

(10) Patent No.: US 7,775,361 B2
(45) Date of Patent: Aug. 17, 2010

(54) PACKAGE FOR ABRASIVE GRINDING WHEELS

(76) Inventor: Giovanni Ficai, Strada Della Costa, 23, Ozzano Taro (PR) (IT) 43046

( * ) Notice: Subject to any disclaimer, the term of this patent is extended or adjusted under 35 U.S.C. 154(b) by 135 days.

(21) Appl. No.: 11/633,560

(22) Filed: Dec. 5, 2006

(65) Prior Publication Data

US 2007/0125674 A1 Jun. 7, 2007

(30) Foreign Application Priority Data

Dec. 7, 2005 (IT) ..... PR2005U000015

(51) Int. Cl.
*B65D 85/00* (2006.01)

(52) U.S. Cl. ..... 206/445; 206/303; 206/349; 206/509

(58) Field of Classification Search ..... 206/349, 206/303, 445, 503, 508, 509, 511; 220/796
See application file for complete search history.

(56) References Cited

U.S. PATENT DOCUMENTS

| | | | | | |
|---|---|---|---|---|---|
| 779,339 | A * | 1/1905 | Wulff | 220/796 |
| 2,142,049 | A * | 12/1938 | Erickson | 206/445 |
| 2,606,708 | A * | 8/1952 | Irvan | 220/796 |
| 3,393,798 | A * | 7/1968 | Beers | 206/372 |
| 3,623,179 | A * | 11/1971 | Roth | 206/446 |
| 3,724,160 | A | 4/1973 | Rechberger | |
| 3,913,774 | A | 10/1975 | Vajtay | |
| 4,063,639 | A | 12/1977 | Grant | |
| 4,183,457 | A | 1/1980 | Loughley et al. | |
| 4,266,689 | A | 5/1981 | Asher | |
| 4,784,263 | A | 11/1988 | Stanley | |
| 5,044,502 | A * | 9/1991 | Hale | 206/595 |
| 5,150,804 | A * | 9/1992 | Blanchet et al. | 220/212 |
| 5,409,128 | A * | 4/1995 | Mitchell | 220/23.4 |
| 6,318,355 | B2 * | 11/2001 | Shiga | 125/35 |
| 6,536,192 | B2 * | 3/2003 | King et al. | 53/476 |
| 2001/0002360 | A1 | 5/2001 | Shiga | |

FOREIGN PATENT DOCUMENTS

| | | | |
|---|---|---|---|
| DE | 20 55 970 | | 6/1972 |
| JP | 03200549 | A * | 9/1991 |

* cited by examiner

*Primary Examiner*—J. Gregory Pickett
(74) *Attorney, Agent, or Firm*—Young & Thompson

(57) ABSTRACT

A package (1, 11) for abrasive grinding wheels that includes a cover (3) and a base (4) adapted to close, seal and insulate the grinding wheels from atmospheric agents, cover (3) and base (4) being made of insulating material from atmospheric agents, for example plastic material. Between base (4) and cover (3), it is possible to interpose a cylindrical body (7) made of cardboard or plastic or plasticized cardboard; the plasticizing being only internal, only external or on both surfaces. The base (4) can comprise a cylindrical mantle (4*b*) defining a space where grinding wheels can be inserted.

6 Claims, 5 Drawing Sheets

PACKAGE FOR ABRASIVE GRINDING WHEELS

The present invention deals with a package for abrasive grinding wheels.

DESCRIPTION OF THE RELATED ART

Currently the above tools are possibly sold and stored in classic types of cardboard boxes, that do not protect in any way the grinding wheels from atmospheric agents.

SUMMARY OF THE INVENTION

Object of the present invention is realizing and making available a package for abrasive grinding wheels that removes the above-cited inconvenience.

Another object is making available suitable arrangements on the package cover and base in order to better stack two or more packages.

These objects and advantages are all obtained by a package for abrasive grinding wheels, subject matter of the present invention, that is characterised by what is provided in the below listed claims.

BRIEF DESCRIPTION OF THE DRAWINGS

These and other characteristics will be better pointed out by the following description of some embodiments shown, merely as a non-limiting example, in the enclosed tables of drawing in which.

DETAILED DESCRIPTION OF THE PREFERRED EMBODIMENTS

Figure 1:
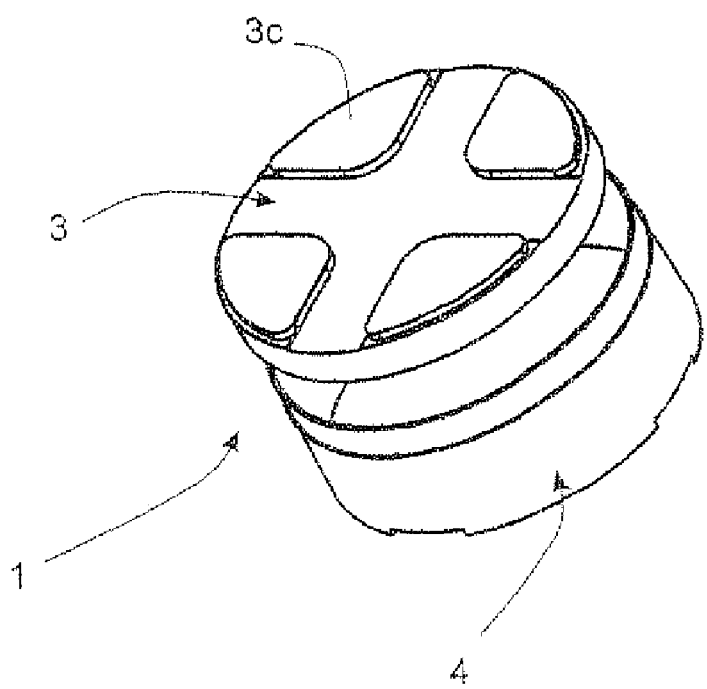
FIG. 1 shows a package for abrasive grinding wheels.
Figure 2:
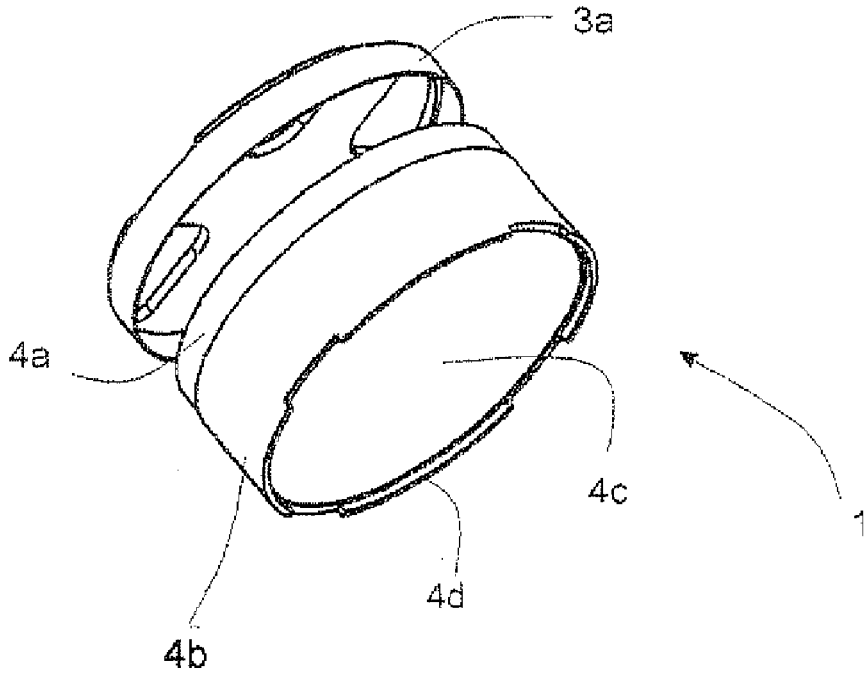
FIG. 2 shows the package of FIG. 1 from another point of view.

With reference to FIGS. 1 and 2, 1 designates a package for grinding wheels, subject matter of the present invention, that is composed of a cylindrical base 4 defining a space where grinding wheels must be inserted, closed by a cover 3 with a corresponding shape.

The cover 3, once coupled, is centered with the upper or end edge region 4*a* of the base 4.

The mantle 4*b* of the base 4 has such a height as to be able to contain more that one stacked grinding wheel disk.

In practice, the base 4 operates as package while the cover 3 performs the function of closing and insulating the grinding wheels from atmospheric agents.

The cover 3 and the base 4 of the package 1 are made of any material adapted to insulate grinding wheels from atmospheric agents; preferably, they will be made of plastic material.

Figure 3:
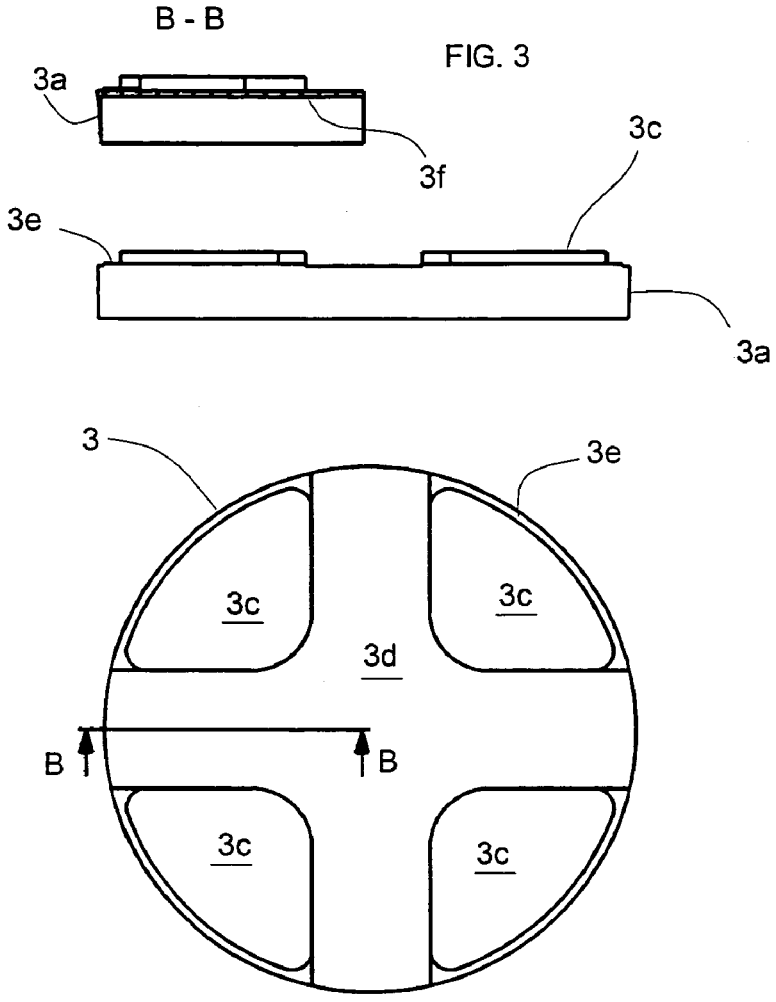
FIG. 3 shows the cover of the package for abrasive grinding wheels, in a top view thereof and in elevation.
Figure 4:
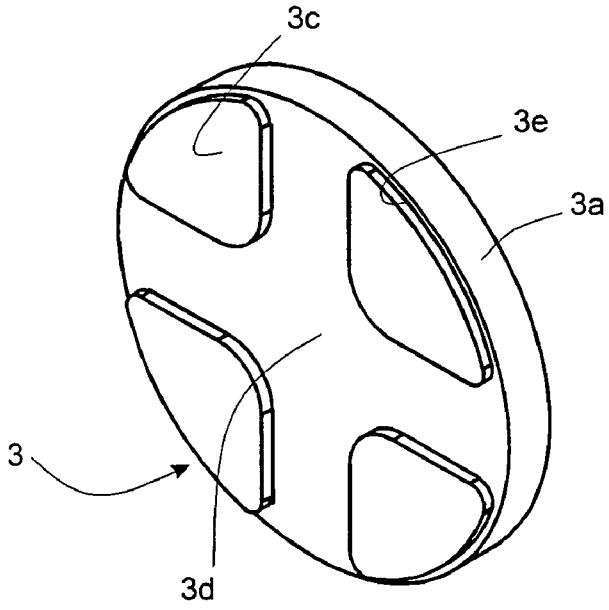
FIG. 4 shows the cover in FIG. 3 in a perspective view.

The cover 3 is shown in detail in FIGS. 3 and 4 in which there are four projections, designated as 3*c*, adapted to define a cross-shaped groove 3*d* whose purpose is described below.

The above projections 3*c*, moreover, have such a shape as to define, if connected by a hypothetical circular joining line, an annular plane space 3*e* peripheral to the cover 3, obtained between said line and the external side surface 3*a*.

Figure 5:
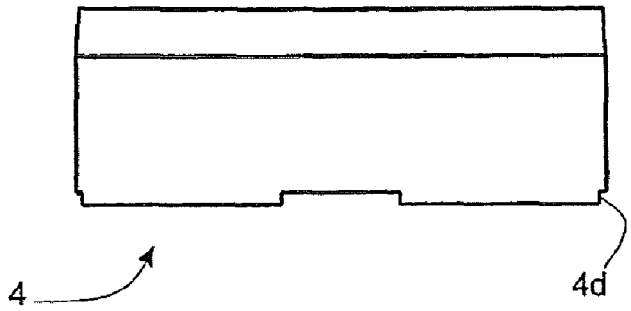
FIG. 5 shows the base of the package for abrasive grinding wheels, in a top view thereof and in elevation.
Figure 5:
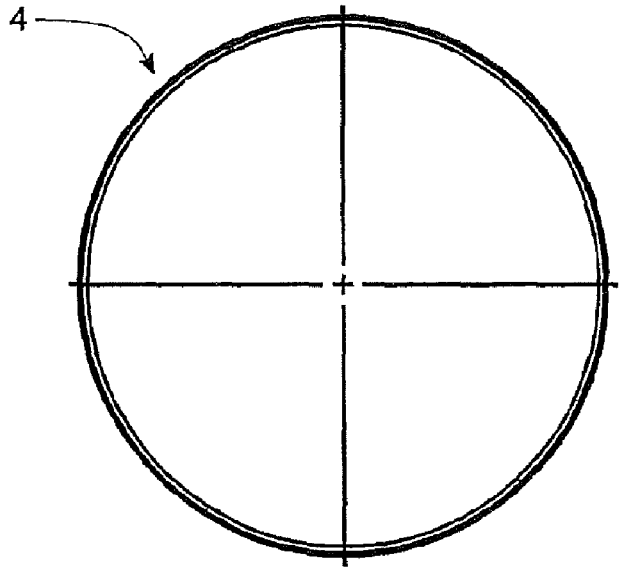
Figure 6:
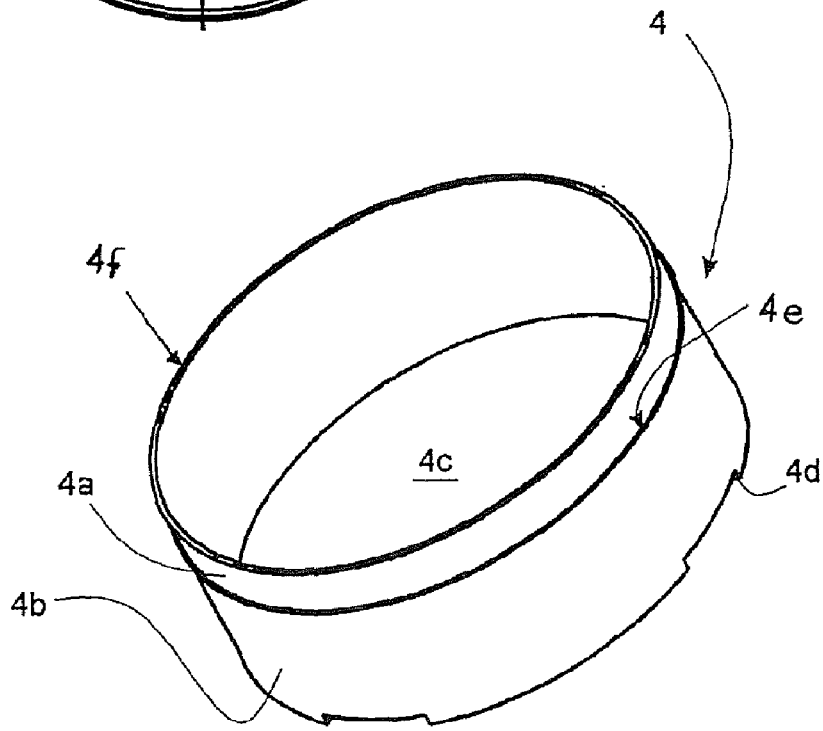
FIG. 6 shows the base of FIG. 6 in a perspective view.

The base 4 is instead shown in detail in FIGS. 5 and 6, where the end edge region 4*a* is recessed with respect to the outer surface of the mantle 4*b*, as can be seen on the mantle 4*b*, said mantle, 4*b* laterally extending with respect to the lower plane part 4*c*, and projecting therefrom in order to define four lips, designated with 4*d*, and that are arranged in a peripheral annular space of the base 4.

The recessed end edge region 4*a* extends between a shoulder 4*e* formed on the mantle 4*b* and an end most part thereof 4*f*.

Obviously, the four lips 4*d* define as many openings, whose purpose will be described below.

Figure 11:
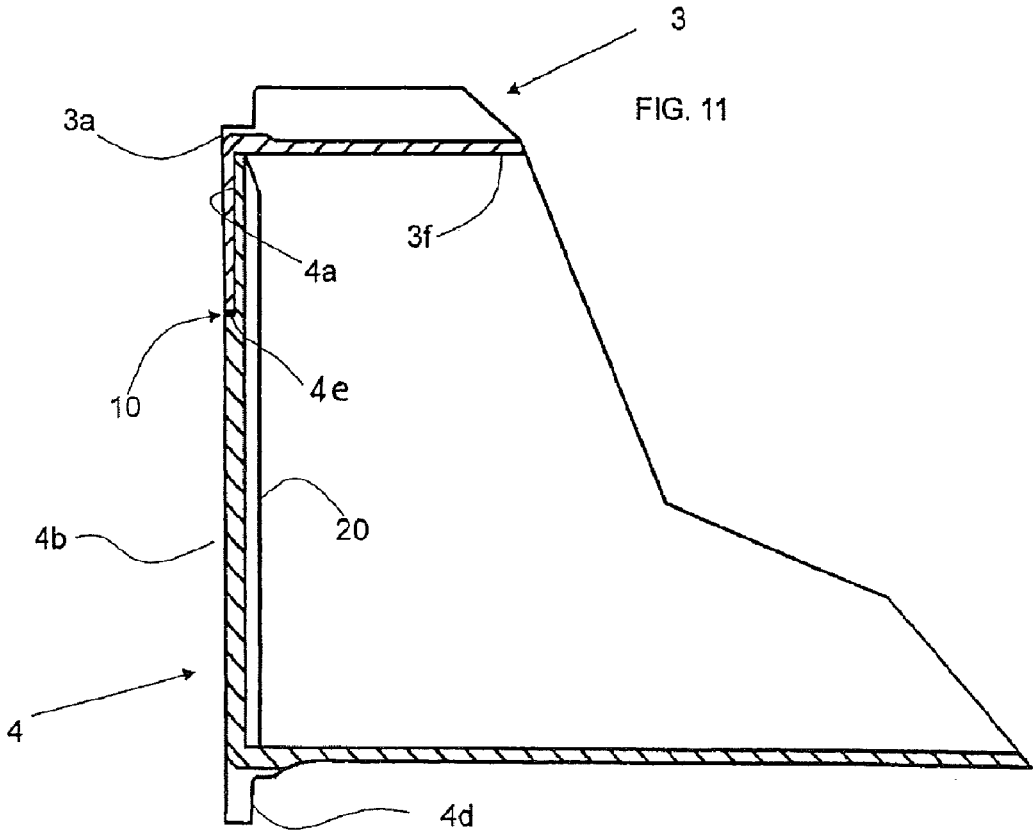
FIG. 11 shows a section of the package of FIG. 1.

With reference to FIG. 11, the coupling is shown, in section, between above cover 3 and base 4.

It must be observed that the upper end most part of the end edge region 4*a* is in contact with the inside surface 3*f* of the cover 3 so that a slit, designated in the figure with 10, is left defined between the shoulder 4*e* of the mantle 4*b* and cover 3.

Purpose of the slit 10 is facilitating the possible cutting of the sealing band, if used, of the package 1 and separating the two components 3 and 4; the use of a band can occur should the weight of internal disk be such as not to impair their strength.

As a variation, the band can be of a type with pre-cut strip or with thread: in both cases, the separation occurs after having removed the strip or thread.

Figure 7:
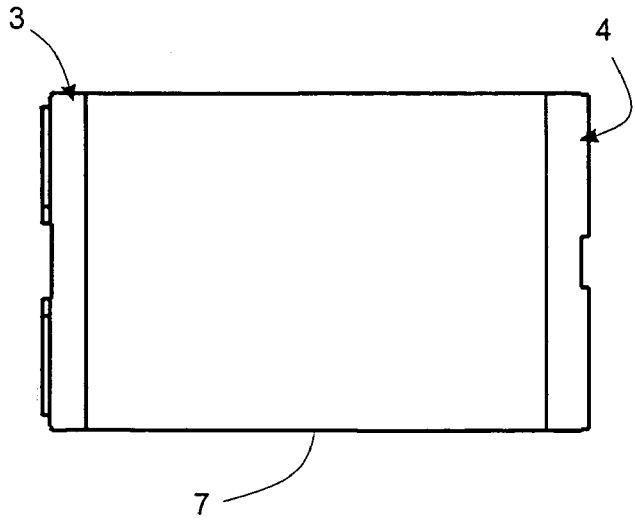
FIG. 7 shows a variation of an embodiment of the package for grinding wheels.
Figure 8:
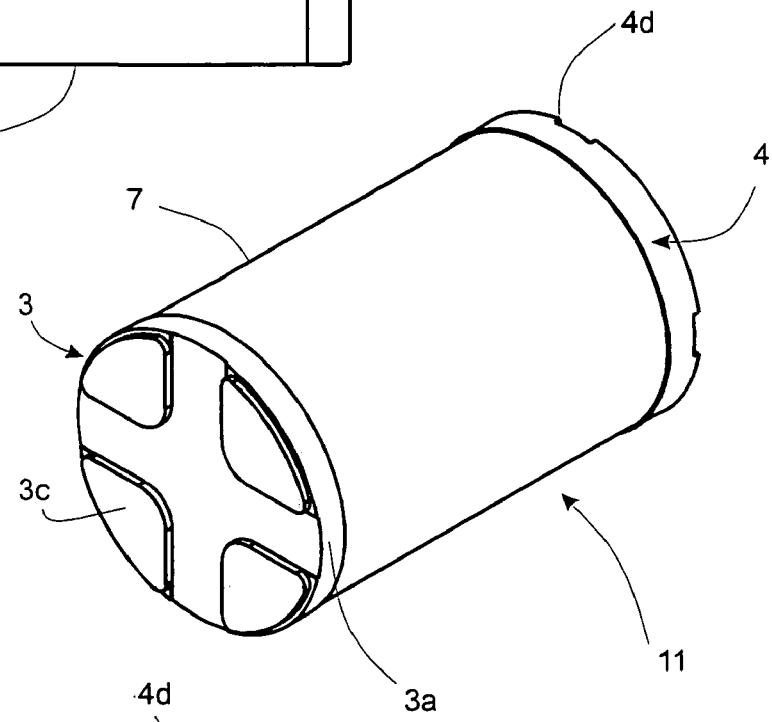
FIG. 8 shows in a perspective view the package of FIG. 7.
Figure 9:
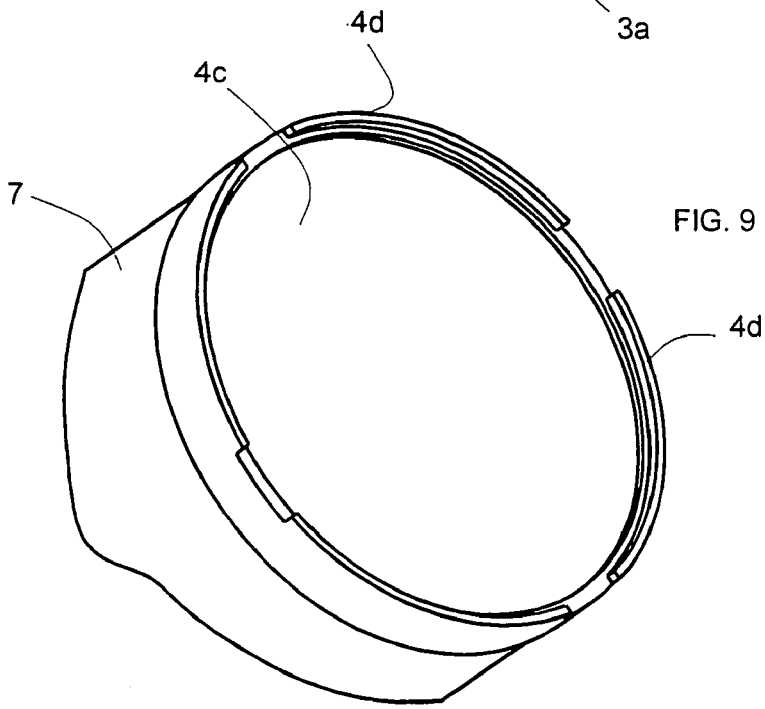
FIG. 9 shows a detail of the bottom of the package of FIGS. 7 and 8.

A variation of an embodiment is shown in FIGS. 7, 8 and 9 in which 11 designates a package for abrasive grinding wheels that has a cylindrical body 7 interposed between base 4 and cover 3.

Cover 3 and base 4 are, like in the previous example, made of any material that is adapted to insulate from atmospheric agents the grinding wheels contained therein, and preferably made of plastic material.

The cylindrical body 7 will be preferably made of cardboard or plastic or plasticized cardboard; in this latter case, plasticizing can be only internal, only external or on both surfaces.

Also in this new embodiment, similar projections 3*c* and lips 4*d* are included on cover 3 and base 4.

The purpose of such cover and of such base is double: firstly, they allow easily and stably strapping the package 1 or 11 since each strap is kept guided in the previously cited cross-shaped recess 3*d*.

Secondly, the lip 4*d* of the base 4 can be snugly engaged with the edge 3*e* of the cover in a possible step of stacking many packages 1 or 11 of the same diameter.

Figure 10:
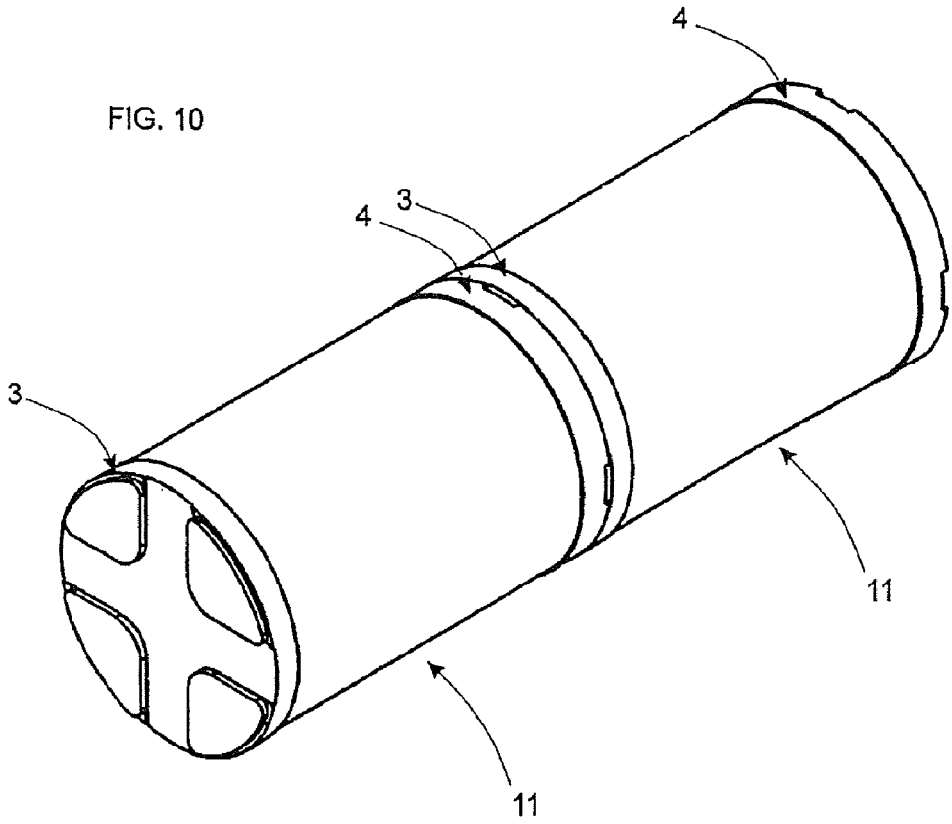
FIG. 10 shows two packages in a joined configuration.

FIG. 10 shows an example of two stacked packages 11, perfectly and conveniently stacked without risks that they mutually slide.

The choice whether to apply a banding or a strapping between cover 3 and base 4 or between cover 3 and body 7 will depend on the weight of the grinding wheels that the package 1 or 11 will have to support.

The cylindrical body 7 is secured to the corresponding base 4 through seaming or equivalent systems.

The choice whether to use the package with plastic mantle, designated with 1, or the one with mantle made of plasticized cardboard, designated with 11, will occur depending on the cost for making the dies and executing its forming.

Both packages 1 and 11, however, fully perform their function of insulating means of grinding wheels from atmospheric agents for which they have been designed.

According to a further variation of an embodiment, the mantle 4*b* or the mantle 7 can have a series of internal ribs 20 in order to settle and centre the grinding wheels in addition to increase their strength.

According to a further variation of an embodiment, not shown, the coupling between cover 3 and base 4 can be performed by means of a threaded coupling in which said cover 3 is screwed onto the edge 4*a* of the base 4.

The cover and the base have been designated as having such projections and edges as to allow stacking and strapping, however it is obvious that, without departing from the scope of the invention, they can be made smooth, thereby limiting the above mentioned function.

The invention claimed is:

1. A package (1, 11) for abrasive grinding wheels, comprising:

a base (4) providing an inner space adapted to contain stacked abrasive grinding wheels; and a cover (3) configured to couple to the base (4) so as to close the inner space, the base (4) and cover (3) being made of insulating material suitable to insulate the contained grinding wheels against atmospheric agents, wherein the base (4) comprises a mantle (4*b*) and an end edge region (4*a*), the mantle (4*b*) having an outer surface and the end edge region (4*a*) being recessed with respect to the outer surface of the mantle (4*b*) such that the mantle (4*b*) forms a shoulder (4*e*) between the outer surface and the end edge region (4*a*), wherein the cover (3) comprises an inside surface (3*f*) and an external side surface (3*a*) pendent therefrom, wherein the external side surface (3*a*) of the cover (3) has a shape configured to overlap the end edge region (4*a*) of the base (4) when the cover (3) is coupled to the base (4), the external side surface (3*a*) and the outer surface of the mantle (4*b*) configured to form a level outer surface when the cover (3) is coupled to the base (4), and an endmost part of the end edge region (4*a*) configured to bear on the inside surface (3*f*) of the cover (3) when the cover (3) is coupled to the base (4) so that a continuous slit (10) is provided between a border end of the external side surface (3*a*) and the shoulder (4*e*) of the mantle (4*b*), wherein the base (4) is cylindrical and has a closing plane part (4*c*), wherein the mantle (4*b*) has a projecting portion that projects from the closing plane part (4*c*) to define four lips (4*d*) arranged in a peripheral annular space of the base, and wherein the side surface (3*a*) of the cover (3) is cylindrical and comprises i) a cover surface surrounded by the side surface (3*a*), and ii) four projections (3*c*) projecting from the cover surface and shaped to define an annular plane portion (3*e*) peripheral to the cover (3) and between outer peripheral edges of the four projections (3*c*) and the external side surface (3*a*), the annular plane portion (3*e*) having a shape such that the four lips (4*d*) of the base snugly engage with the annular plane portion (3*e*) of the cover when the cover (3) is coupled to the base (4), and the four projections (3*c*) defining a cross-shape groove (3*d*) shaped so as to receive and contain package strapping.

2. The package according to claim 1, wherein the mantle (4*b*) comprises a plurality of internal ribs (20).

3. The package according to claim 1, further comprising:

a cylindrical body (7) configured to be interposed between said base (4) and said cover (3), said cylindrical body (7) being made of one of cardboard, plastic, and plasticized cardboard.

4. The package according to claim 3, wherein the cylindrical body (7) is configured to be fastened to a corresponding base (4) by seaming.

5. The package according claim 3, wherein said cylindrical body is made of platicized cardboard, the plasticizing being on one of an internal surface of said cylindrical body and an external surface of said cylindrical body.

6. The package according claim 3, wherein said cylindrical body is made of platicized cardboard, the plasticizing being on both an internal surface of said cylindrical body and an external surface of said cylindrical body.

* * * * *